US005572803A

United States Patent [19]

Moriya

[11] Patent Number: 5,572,803

[45] Date of Patent: Nov. 12, 1996

[54] DRYING DEVICE FOR WORKED METAL PARTS

[75] Inventor: Yasuo Moriya, Kawasaki, Japan

[73] Assignee: Fujitsu Limited, Kawasaki, Japan

[21] Appl. No.: 425,925

[22] Filed: Apr. 20, 1995

[30] Foreign Application Priority Data

Aug. 3, 1994 [JP] Japan ..... 6-182019

[51] Int. Cl.[6] ..... F26B 11/02

[52] U.S. Cl. ..... 34/595; 34/602

[58] Field of Search ..... 34/602, 607, 595

[56] References Cited

U.S. PATENT DOCUMENTS 2,787,841 4/1957 Warino ..... 34/602

3,853,622 12/1974 Rutten ..... 34/595

5,438,766 8/1995 Nakamura ..... 34/595

5,495,681 3/1996 Paradis ..... 34/602

*Primary Examiner*—John T. Kwon

*Attorney, Agent, or Firm*—Armstrong, Westerman Hattori, McLeland & Naughton

[57] ABSTRACT

A drying device for worked metal parts which can prevent the worked metal parts from sticking to each other to efficiently dry the whole of the parts in a short time. The drying device includes a turntable rotatably mounted, a cage detachably mounted on the turntable for containing the worked metal parts, a driving device for rotating the turntable, magnets fixed to the turntable, and an air nozzle device for blowing air toward the cage.

6 Claims, 8 Drawing Sheets

DRYING DEVICE FOR WORKED METAL PARTS

BACKGROUND OF THE INVENTION

1. Field of the Invention

The present invention relates to a drying device for worked metal parts which can efficiently dry the worked metal parts after washed.

2. Description of the Related Art

In recent years, the influence of a washing agent or the like upon environments has become a problem, and there is a trend that the use of chlorofluorocarbon, trichloroethane, etc. conventionally used as an all-purpose washing agent has been gradually prohibited. Then, desired is the establishment of a washing process using a washing agent such as a water base or hydrocarbon base washing agent as an alternative washing liquid.

In working a sheet metal such as punching to form worked metal parts, oil is applied to the sheet metal in advance. Accordingly, the worked metal parts are washed to remove the oil by conventionally using an all-purpose washing liquid such as chlorofluorocarbon or trichloroethane. As such an all-purpose washing liquid has a low boiling point, it shows a characteristic of entering a gap between the worked metal parts sticking to each other and also shows a characteristic of drying in a short time. Owing to these characteristics of the all-purpose washing liquid, there hardly occurs a problem that the worked metal parts stick to each other to cause insufficient washing and drying as in the case of using a washing agent such as water base or hydrocarbon base washing agent.

However, the recent trend on the use of chlorofluorocarbon, trichloroethane, etc. is toward the prohibition for protection of environments as mentioned above, so that a washing process using an alternative washing agent such as a water base or hydrocarbon base washing agent has been greatly investigated for washing of worked metal parts. In general, such a washing process includes a washing step, a rinsing step for rinsing off the washing agent, and a drying step. For example, barrel drying is employed in the drying step. The barrel drying is a method of forcibly drying worked metal parts after washed by rotating a cage containing the parts and simultaneously blowing air toward the cage.

In performing the barrel drying after washing the worked metal parts with the alternative washing agent such as the water base or hydrocarbon base washing agent, the worked metal parts scattered in the washing step and the rinsing step tend to be collected at one position by the rotation of the cage. The collection of the worked metal parts, especially, plate-like worked metal parts formed from a sheet metal, at one position causes sticking of the parts to each other due to water drops on their surfaces. As a result, moisture (washing liquid and/or rinsing liquid) remaining between the surfaces of the parts sticking to each other cannot be dried off.

SUMMARY OF THE INVENTION

It is therefore an object of the present invention to provide a drying device for worked metal parts which can prevent the worked metal parts from sticking to each other to efficiently dry the whole of the parts in a short time.

In accordance with an aspect of the present invention, there is provided a drying device for worked metal parts, comprising a turntable rotatably mounted; a cage detachably mounted on the turntable, for containing the worked metal parts; driving means for rotating the turntable; magnets fixed to the turntable; and air nozzle means for blowing air toward the cage.

Preferably, the magnets comprise electromagnets, and the electromagnets are magnetized in a timed manner. Further, permanent magnets may be mounted on the cage rather than fixing the magnets to the turntable.

Since the magnets are fixed to either the turntable or the cage, the worked metal parts can be partially temporarily fixed by simple means, so that the collection of the parts due to the rotation of the cage containing the parts therein and the air blow from the air nozzle means can be suppressed to prevent the parts from sticking to each other. Even if the parts stick to each other, the parts can be slid to separate from each other by the temporary fixing of some of the parts by means of the magnets in addition to the rotation of the cage and the air blow.

Thus, in drying the washed worked metal parts by the use of the drying device of the present invention, the parts can be prevented from sticking to each other, thereby allowing efficient drying of the whole of the parts in a short time.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Some preferred embodiments of the present invention will now be described in detail with reference to the drawings.

Prior to drying, worked metal parts are washed with an alternative washing agent such as a water base or hydrocarbon base washing agent, and are then rinsed. More specifically, the washing is performed by putting plate-like worked metal parts formed from a sheet iron into a washing cage and then immersing the worked metal parts in a washing liquid for about 1 to 3 minutes. Thereafter, the rinsing is performed by immersing the worked metal parts in water for about 30 to 60 seconds. The worked metal parts thus rinsed are dried by a drying device according to a preferred embodiment of the present invention to be hereinafter described.

Figure 1:
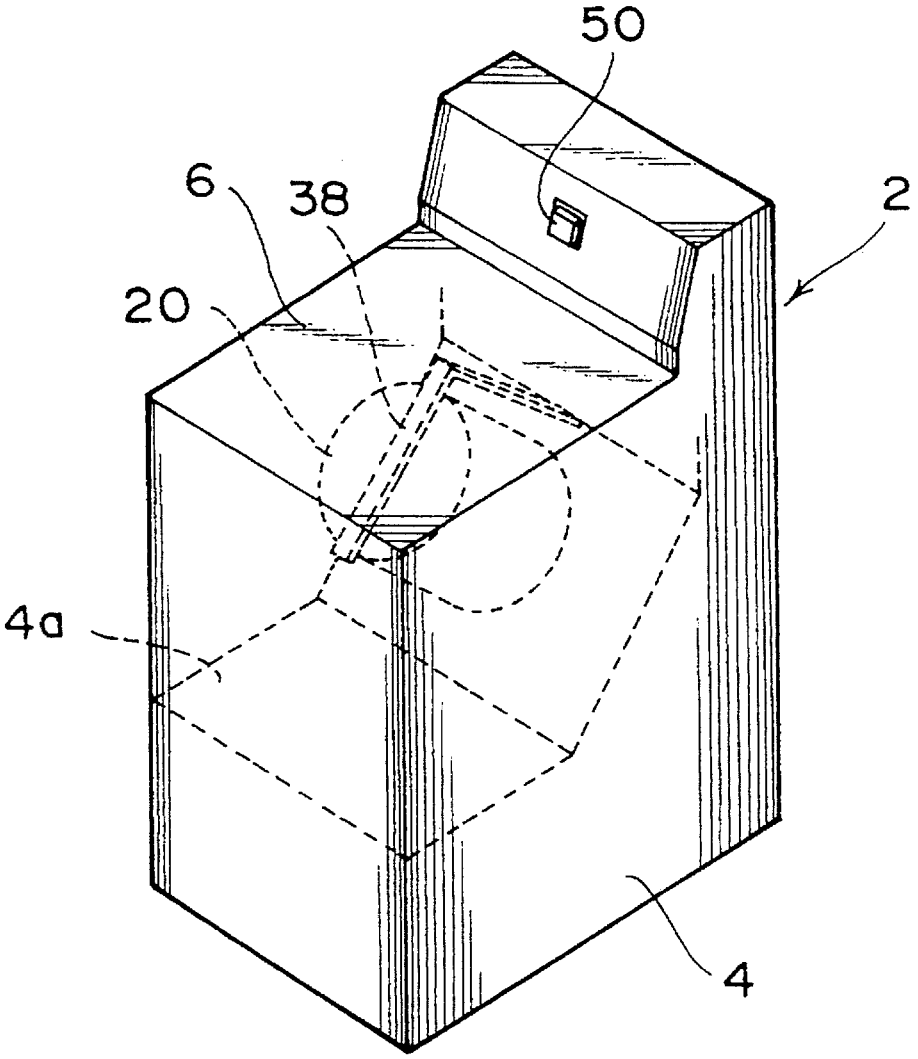
FIG. 1 is a perspective view showing the appearance of a drying device according to the present invention.
Figure 2:
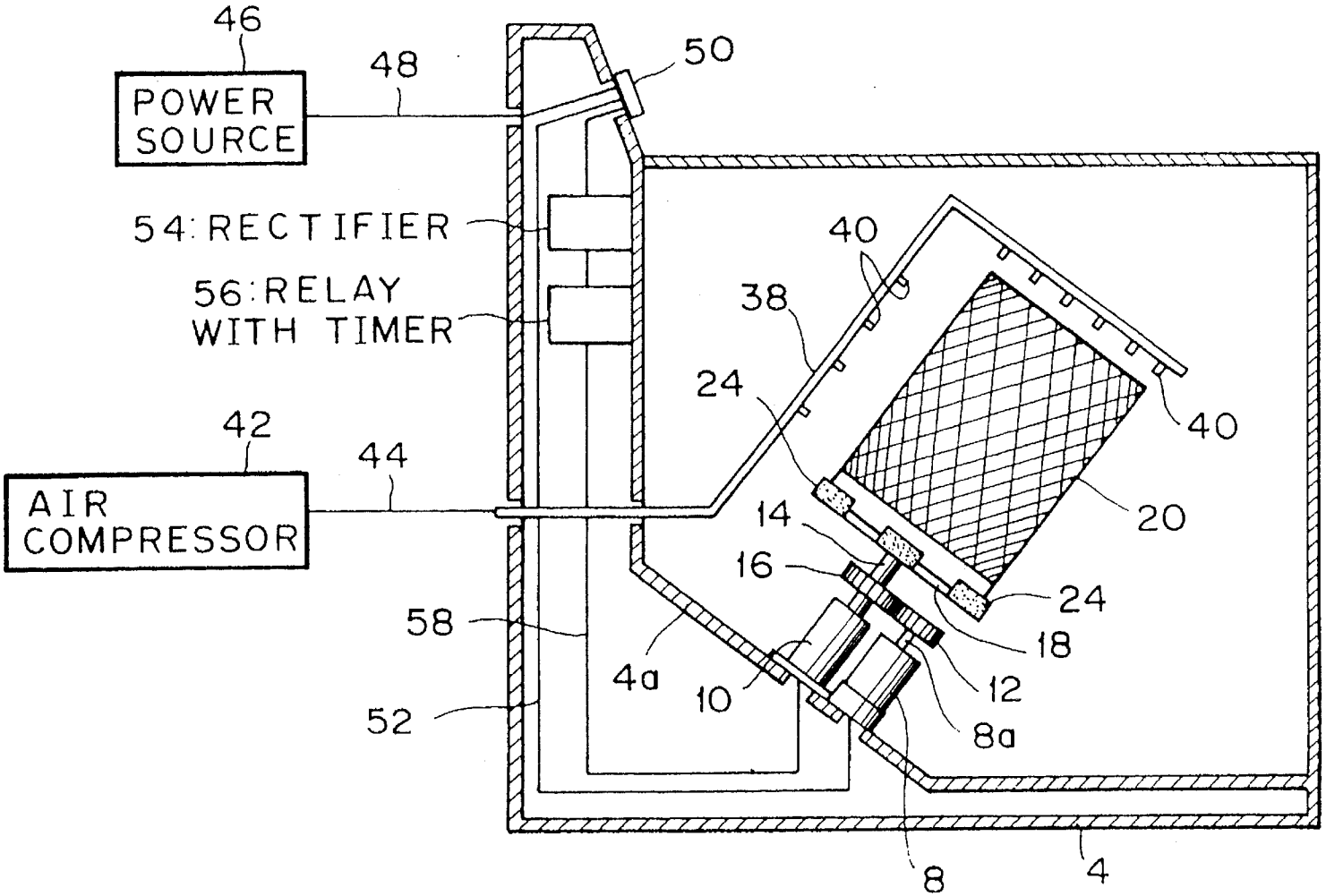
FIG. 2 is a sectional view of a first preferred embodiment of the present invention.

Referring to FIG. 1, the drying device at 2 includes a housing 4 and a cover 6, and a cage 20 containing the worked metal parts to be dried is rotatably mounted in the housing 4. Referring to FIG. 2, a motor 8 and a hollow shaft 10 are fixed to an inclined wall 4*a* of the housing 4. A gear 12 is fixed to an output shaft 8*a* of the motor 8. A shaft 14 is rotatably supported to the hollow shaft 10, and a gear 16 meshing with the gear 12 is fixed to the shaft 14. A turntable 18 is fixed to an upper end of the shaft 14. Accordingly, the turntable 18 is rotatably mounted in such a condition that it is inclined at 20 to 45 degrees to a horizontal plane.

Figure 3:
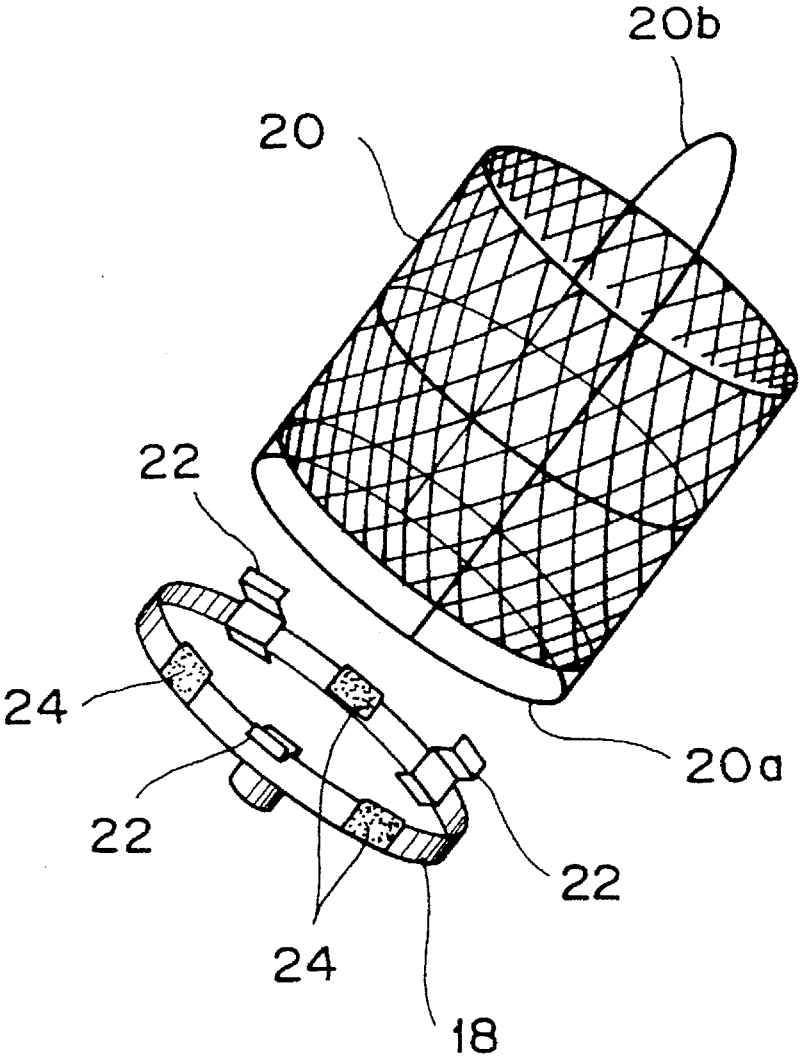
FIG. 3 is an exploded perspective view of a cage and a turntable in the first preferred embodiment.
Figure 4:
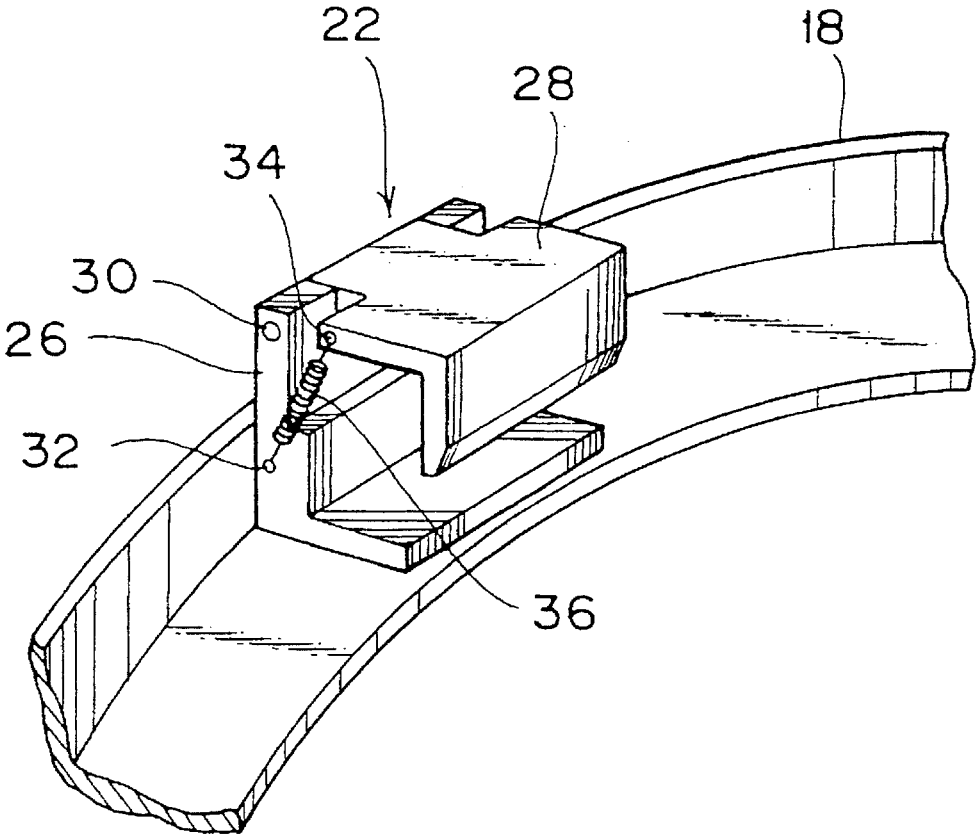
FIG. 4 is a perspective view of a fastener for fixing the cage.

As best shown in FIG. 3, four electromagnets 24 are fixed to the turntable 18. Further, three fasteners 22 for fixing the cage 20 to the turntable 18 are fixed to the turntable 18. Each fastener 22 is constructed as shown in FIGS. 4, 5A, and 5B, and it includes an L-shaped fixed member 26 fixed to the turntable 18, a shaft 30 fixed to the fixed member 26, and an L-shaped pivotable member 28 pivotably mounted on the shaft 30.

Figure 5A:
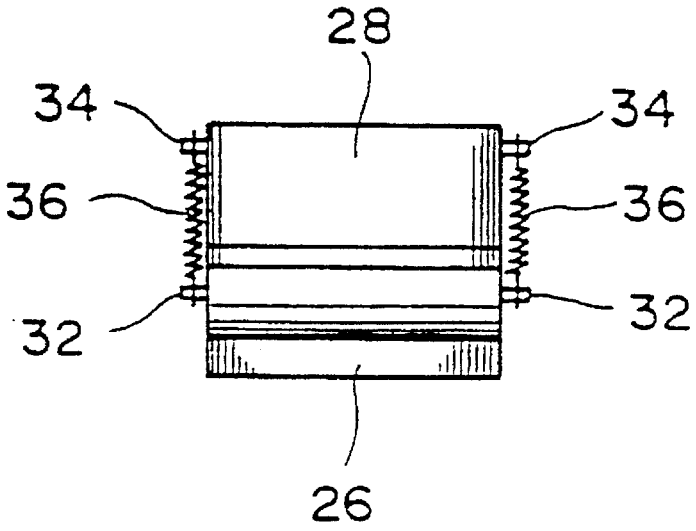
FIG. 5A is an elevational view of the fastener.
Figure 5B:
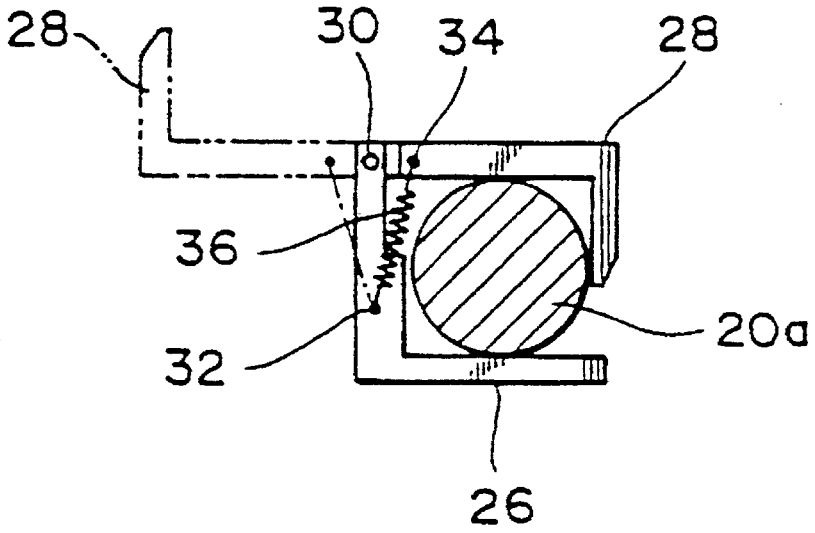
FIG. 5B is a side view of the fastener.

As shown in FIG. 5A, a pair of pins 32 project from opposite side surfaces of the fixed member 26, and a pair of pins 34 also project from opposite side surfaces of the pivotable member 28. A coil spring 36 is stretched between the pins 32 and 34 on each side. Accordingly, the pivotable member 28 is held in two positions as shown by a solid line and a phantom line in FIG. 5B by a tensile force of the coil springs 36 owing to an over-center mechanism.

Referring again to FIG. 3, the cage 20 is formed from a stainless steel wire, and is integrally formed at its lower end with an annular mounting portion 20*a* for fixing the cage 20 to the turntable 18. Further, the cage 20 is formed at its upper end with a handle 20*b* for allowing easy transportation of the cage 20. Although not shown in FIGS. 2 and 3, a plurality of worked metal parts formed from a sheet iron after washed are contained in the cage 20.

The cage 20 is detachably mounted on the turntable 18 in the following manner. The pivotable member 28 of each fastener 22 is first opened as shown by the phantom line in FIG. 5B, and the cage 20 is mounted on the turntable 18. Then, the pivotable member 28 is pivoted clockwise to the closed position shown by the solid line in FIG. 5B, so that the annular mounting portion 20*a* of the cage 20 is strongly pressed by the pivotable member 28 of each fastener 22 biased by the elastic force of the coil springs 36 on both sides of the pivotal member 28, thereby fixing the cage 20 to the turntable 18. Since the pivotal member 28 of each fastener 22 is mounted to the fixed member 26 by the over-center mechanism, the fixing of the cage 20 to the turntable 18 or the removal of the cage 20 from the turntable 18 can be easily carried out by simply pivoting the pivotable member 28 of each fastener 22 clockwise or counterclockwise.

Referring again to FIG. 2, a pipe 38 having a plurality of nozzles 40 is provided adjacent to the cage 20. The pipe 38 is connected through a conduit 44 to an air compressor 42. A power source 46 is provided to supply electric power through a cord 48, a switch 50, and a cord 52 to the motor 8. On the other hand, the power source 46 is connected through the cord 48, the switch 50, a rectifier 54, a relay with timer 56, and a cord 58 to the electromagnets 24. Accordingly, a magnetic force of the electromagnets 24 can be controlled by controlling current and voltage to be applied to the electromagnets 24 with the rectifier 24. Further, the electromagnets 24 can be turned on and off at given intervals by the relay with timer 56.

Figure 6A:
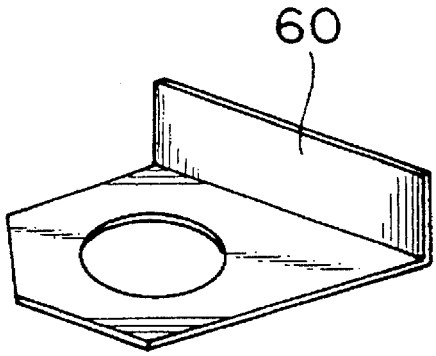
FIGS. 6A and 6B are perspective views of different examples of worked metal parts.
Figure 6B:
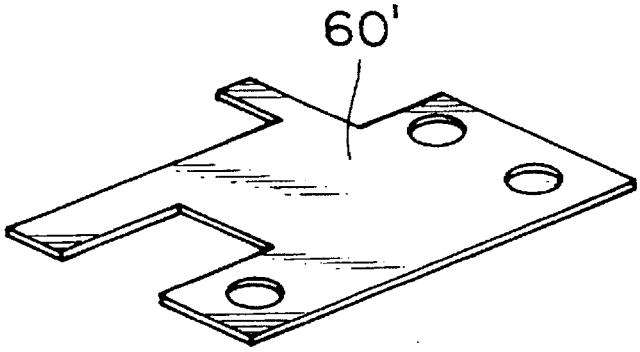

FIGS. 6A and 6B show different examples of a piece of worked metal parts, each of the examples being formed from a sheet iron. A piece of worked metal parts 60 shown in FIG. 6A is formed by cutting a sheet iron into a desired shape and then forming a punched hole and a bend. On the other hand, a piece of worked metal parts 60' shown in FIG. 6B is formed by cutting a sheet iron into a desired shape and then forming a plurality of punched holes. The drying device according to the preferred embodiment is especially suitable for drying of the plate-like worked metal parts as shown in FIGS. 6A and 6B.

Figure 7:
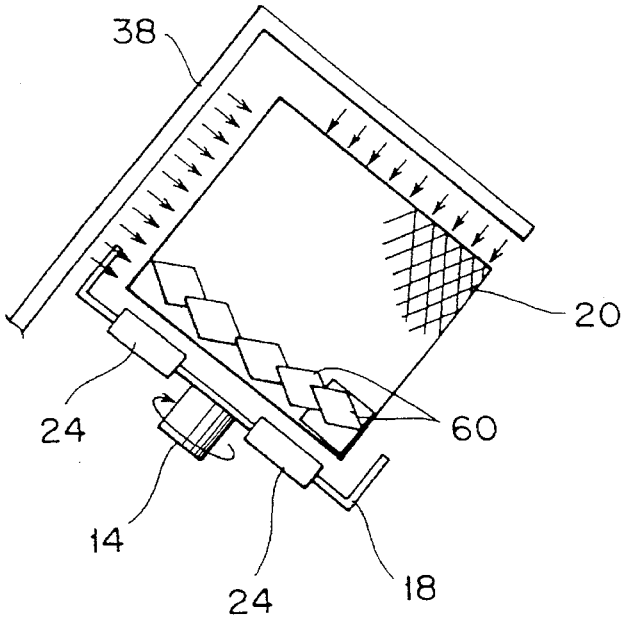
FIG. 7 is a side view illustrating the operation of the first preferred embodiment.

The operation of the above-mentioned preferred embodiment will now be described. The cage 20 containing the plural worked metal parts raised from a rinsing bath is fixed to the turntable 18. As shown in FIG. 7, air is blown from the nozzles 40 against the cage 20 and the worked metal parts 60 contained therein while the cage 20 being rotated at about 20 rpm. The air from the nozzles 40 is blown under a pressure of about 4 kg/cm2. Such barrel drying is performed for about 3 minutes. Since the electromagnets 24 are fixed to the turntable 18, the worked metal parts 60 can be partially temporarily fixed by the electromagnets 24. Accordingly, the collection of the worked metal parts 60 due to the rotation of the cage 20 and the air blow can be suppressed to thereby prevent the parts 60 from sticking to each other.

Even if the parts 60 stick to each other, the parts 60 can be slid to separate from each other by the magnetic attraction of the electromagnets 24 partially to the parts 60 as well as the rotation of the cage 20 and the air blow. In this manner, the overlap of the parts 60 can be effectively prevented to thereby efficiently dry the whole of the parts 60 in a short time. Since the electromagnets 24 are mounted on the turntable 18, the magnetic force of the electromagnets 24 can be controlled by the rectifier 54. Furthermore, since the electromagnets 24 can be on-off controlled by the relay with timer 56, the overlap of the parts 60 can be effectively prevented. Of course, permanent magnets instead of the electromagnets 24 may be fixed to the turntable 18.

Figure 8:
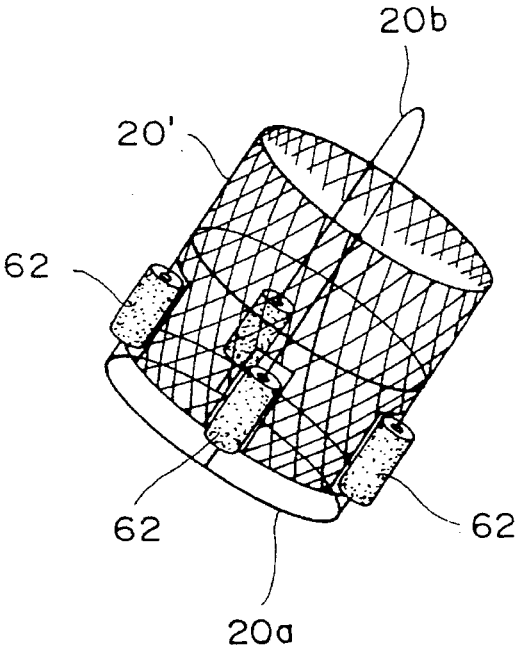
FIG. 8 is a perspective view of a cage according to a second preferred embodiment of the present invention.
Figure 9:
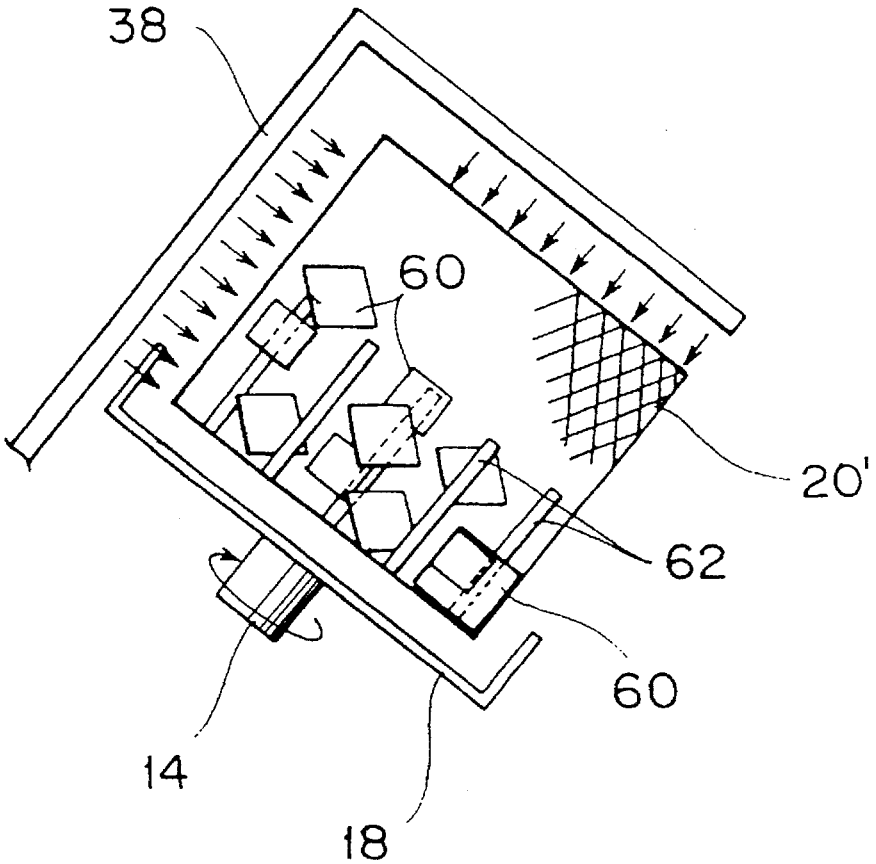
FIG. 9 is a side view illustrating the operation of the second preferred embodiment.

Referring to FIG. 8, there is shown a perspective view of a cage 20' according to a second preferred embodiment of the present invention. As similar to the first preferred embodiment, the cage 20' is formed from a stainless steel wire. Four permanent magnets 62 are mounted on the outer circumference of the cage 20'. The other elements of the cage 20' are similar to those of the cage 20 in the first preferred embodiment. Also in the second preferred embodiment, air is blown from the nozzles 40 of the pipe 38 against the cage 20' and the worked metal parts 60 contained therein while the cage 20' is being rotated at about 20 rpm, and such barrel drying is performed for about 3 minutes, as shown in FIG. 9.

Since the permanent magnets 62 are mounted on the cage 20', the worked metal parts 60 can be partially temporarily fixed by the magnets 62, thereby preventing the worked metal parts 60 from sticking to each other. Thus, the prevention of sticking of the worked metal parts 60 allows efficient drying of the parts 60 as a whole in a short time.

According to the present invention, in drying the plate-like worked metal parts contained in the cage, the worked metal parts can be simply temporarily fixed by the magnets. Therefore, the collection of the parts due to the rotation of the cage and the air blow can be suppressed to thereby prevent the parts from sticking to each other.

Even if the worked metal parts stick to each other, the parts overlapped each other can be slid to separate from each other because the parts are partially attracted to the magnets and air is blown against the parts during rotation of the cage. Accordingly, the sticking of the parts can be effectively prevented to allow efficient drying of the whole of the parts in a short time.

What is claimed is:

1. A drying device for worked metal parts, comprising:

a turntable rotatably mounted;

a cage detachably mounted on said turntable, for containing said worked metal parts;

driving means for rotating said turntable;

magnets fixed to said turntable; and air nozzle means for blowing air toward said cage.

2. A drying device for worked metal parts according to claim 1, wherein said turntable is inclined at a given angle to a horizontal plane.

3. A drying device for worked metal parts according to claim 1, wherein said magnets comprise electromagnets.

4. A drying device for worked metal parts according to claim 1, wherein said magnets comprise permanent magnets.

5. A drying device for worked metal parts, comprising:

a turntable rotatably mounted;

a cage detachably mounted on said turntable, for containing said worked metal parts;

driving means for rotating said turntable;

magnets fixed to said cage; and air nozzle means for blowing air toward said cage.

6. A drying device for worked metal parts according to claim 5, wherein said turntable is inclined at a given angle to a horizontal plane.

* * * * *